United States Patent [19]

Jeynes et al.

[11] Patent Number: 4,991,256

[45] Date of Patent: Feb. 12, 1991

[54] DOOR CLOSERS

[75] Inventors: Roger H. Jeynes, Birmingham; John W. Sewell, Redditch, both of England

[73] Assignee: Samuel Heath & Sons, Birmingham, England

[21] Appl. No.: 315,623

[22] Filed: Feb. 23, 1989

[30] Foreign Application Priority Data

Feb. 24, 1988 [GB] United Kingdom ..... 8804317

[51] Int. Cl.[5] ..... E05F 1/00

[52] U.S. Cl. ..... 16/78; 16/61

[58] Field of Search ..... 16/61, 63, 78

[56] References Cited

U.S. PATENT DOCUMENTS

| | | | |
|---|---|---|---|
| 1,478,376 | 12/1923 | Bernhard | 16/61 |
| 1,834,609 | 12/1931 | Fitts | 16/78 |

FOREIGN PATENT DOCUMENTS

| | | | |
|---|---|---|---|
| 1044911 | 10/1966 | United Kingdom . | |
| 1263214 | 2/1972 | United Kingdom . | |
| 2044840 | 10/1980 | United Kingdom | 16/61 |
| 2108576 A | 5/1983 | United Kingdom . | |

*Primary Examiner*—Richard K. Seidel
*Assistant Examiner*—Carmine Cuda
*Attorney, Agent, or Firm*—Fulwider, Patton, Lee & Utecht

[57] ABSTRACT

In a door closer comprising spring means (17) within a housing (10) adapted for mounting with the thickness of the door (12) and an anchor member (30) adapted for mounting on a door frame (32), a tension member (20) whereby the spring means draws the anchor member towards the housing to effect door closure includes at least an outer end portion in the form of a cable (21) at its free end a domed abutment member (22) which is engaged behind the anchor member (30) and at a position spaced from the abutment member a collar (25) of non-round external shape whereby firstly a spacer member (40) can be interposed between the collar (25) and the housing (10) to facilitate the mounting of the closer, and secondly by engagement of the collar (25) by means of a spanner (50) the capable can be rotated to adjust the spring force of the closer through axial movement of a member (18) which is acted on by the spring (15) relative to a threaded member (19) at the inner end of the tension member (20).

12 Claims, 2 Drawing Sheets

FIG 1
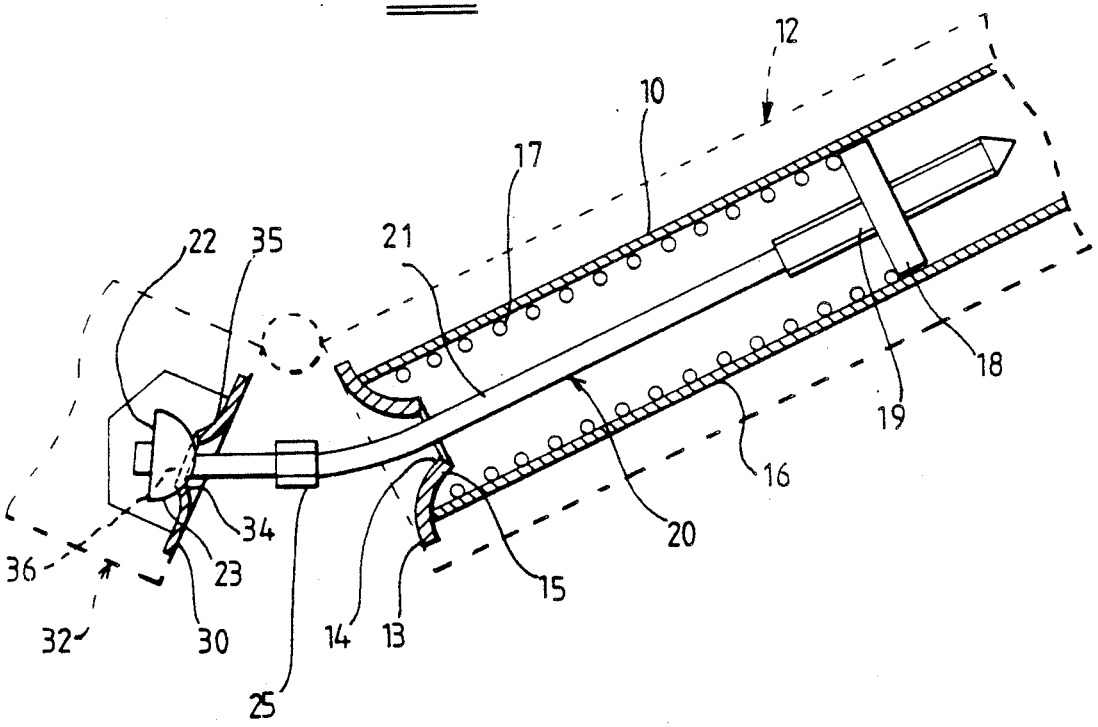
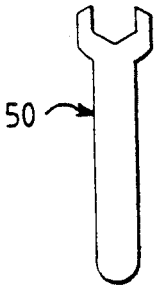
FIG 2A
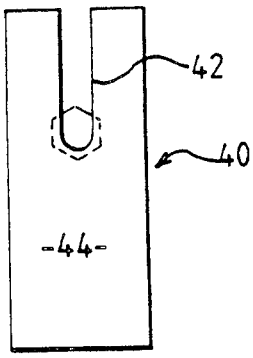
FIG 2B

DOOR CLOSERS

BACKGROUND OF THE INVENTION

This invention relates to door closers of the kind including a housing for mounting within the thickness of a door, spring means within the housing and acting on a tension member which extends outwardly from the housing and is coupled to an anchor member for securing to a door frame at a position adjacent to said housing, in use said spring means acting to draw the housing and the anchor member together thereby closing the door relative to the door frame.

For examples of such door closers reference may be made to British patent specification No. 1044911. In the construction disclosed therein, the tension member includes an outer end portion which is in the form of an articulated chain. The use of such a chain has the advantage that it is mechanically simple and yet allows the door to swing through substantially 180° providing the chain length is sufficient.

In other constructions, as for example described in British patent specification No. 1263214, the tension member includes a rigid linkage, but this has the disadvantage that the geometry of the linkage system usually imposes a significant restriction on the angle through which the door can swing, and for this reason a flexible member is to be preferred. In practice, such a flexible member, has so far as we are aware, always been formed as a chain of some kind, having a finite number of links.

In general, this is satisfactory as such chains are readily available, but we have found that under some circumstances the chains conventionally used can have two disadvantages. Firstly, it has been customary to employ chains in which the links are articulated and are flexible in only one plane. Closers employing such chains cannot therefore be used on doors with rising butt hinges, and the anchor member needs to be quite accurately aligned with the housing when the closer is fitted. Moreover, if the door drops over an extended period of use, the chain may jam due to its lack of flexibility in a vertical plane.

Secondly, the length of such a chain is not infinitely variable, since it can only comprise an integral number of links.

In designs of the type described in British patent specification No. 1044911, the tension member has at its innermost end an adjustable connection with a component against which the spring means acts to draw the tension member into the housing. Adjustment of this connection enables the force exerted by the spring to be varied. Thus, the effort required by the user when opening the door from its closed position can be regulated, or the force exerted by the spring can be adjusted to suit the weight of the door. However, since the chain connected to the anchor member is of a predetermined length, alteration of the spring setting may restrict the degree to which the door can be opened, this being resisted by compression of the spring to the extent that adjacent turns of the coil come into contact.

In general terms the present invention involves in the use of a tension member in which at least an outer end portion comprises a flexible cable which terminates in an abutment engaging behind the anchor member, the cable having a collar fixedly secured thereto at a position spaced from said abutment member, a suitable tool enables the cable to be rotated about its center line to effect adjustment whereby engagement of a spacer member between said collar and said housing prevents the anchor member being drawn up to the housing so as to facilitate installation of the door closer or prevent closure of the door when so required after installation.

SUMMARY OF THE INVENTION

More specifically, the invention resides in a door closer comprising a housing adapted for mounting within the thickness of a door, an anchor plate adapted for mounting on a door frame at a position adjacent to said housing, a spring member within said housing, an elongate tension member coupled at one end of said spring member within said housing and at its other end to said anchor member, said spring member acting to draw the anchor member and said housing towards one another thereby closing the door relative to the frame, wherein at least an outer end portion of said tension member comprises a flexible capable which terminates in an abutment member engaging behind said anchor member, the cable having a collar fixedly secured thereto at a position spaced from the abutment member.

When the closer further comprises an externally screw-threaded member secured to said tension member at the end thereof within said housing and an internally screw-threaded member in threaded engagement with said externally screw-threaded member and abutted by said spring member, the collar is preferably of non-round external shape so that by engagement of said collar with an appropriate tool the cable may be rotated about its center line to rotate said externally screw-threaded member and thereby adjust the axial position of said internally screw-threaded member relative to said externally screw-threaded member to adjust compression of said spring member.

The collar may be secured to the cable by crimping or in any other suitable manner, and is preferably of hexagonal form externally, although other shapes may be employed.

The use of a cable has the advantage that it is flexible in two perpendicular planes so that the closer can be used with rising butt hinges or when there is a substantial degree of vertical mis-alignment between the housing and the anchor member, but unlike a chain of articulated links it is not inherently capable of abutment with a spacer member in such a way as to prevent the anchor member being drawn fully up to the housing. This facility is especially important for the step of installing the closer. To enable the anchor member to be secured to the door frame, it must be separated from the housing and a workman cannot easily hold the anchor member out of engagement with the housing against the force of the closer spring and at the same time secure the anchor member in place on the door frame by means of suitable fastening elements such as screws. To overcome this drawback, and in accordance with the invention, the collar previously mentioned is fixedly secured to the cable at a position spaced from the abutment member at the free end of the cable.

Moreover, in the case of door closers of the kind in which adjustment of the spring force is achieved as a result of relative axial adjustment of two threadedly engaging members by rotation of the tension about its longitudinal center line, this adjustment could not normally be achieved where the tension member, or at least that part of it which can extend outwardly of the housing, comprises a cable. However, by the surprisingly simple expedient of forming the aforesaid collar with a non-round external shape, so as to enable it to be engaged by a correspondingly shaped tool, such as a spanner, the problem of rotation of the cable to effect adjustment of the spring free is overcome.

Therefore, the invention, surprisingly, offers a substantial further advantage in the matter of such adjustment as described above, in that the length of the cable can be chosen specifically to suit the geometry of a particular hinge system, especially hinges of the stand-off type. It will be understood that the effective length of the cable will need to be longer with stand-off hinges than with the normal type, and that the length required will depend on the geometry of the particular type.

By employing a cable instead of a chain, the length can be tailored to a specific hinge geometry so that the full range of adjustments is available without adversely affecting the operating characteristics of the closer.

Additionally the tensile strength of a cable may be substantially greater than that of a link chain of comparable cross-section for example a breaking load of approximately 0.5 ton for a cable compared with 0.2 ton for a chain.

Thus, the provision of the fixed collar on the cable is capable of serving two functions. Firstly, it provides a ready means for preventing the anchor member being drawn fully up to the housing. This is particularly desirable during the operation of installing the closer, since then it is necessary for the anchor member to be mounted on the door frame, and for this purpose it is necessary for the anchor member to be separated from the main housing by a sufficient distance to enable screws or other fastening elements to be used to secure the anchor member in position. Whilst with previously employed tension members which are in the form of an articulated chain, it has been possible to engage a spacer member with a link of such chain, no such possibility exists with a tension member in the form of a cable or the like, and this is a serious disadvantage mitigating against the use of a cable despite its other advantages, and the provision of such collar in accordance with the invention overcomes this disadvantage in a surprisingly simple and effective manner. Secondly, where the collar is of non-rounded external shape, it enables the cable to be rotated to adjust the spring tension of the closer as described above.

Preferably the abutment member affords a bearing surface shaped to facilitate relative rotation between the cable and the anchor member and in one embodiment this bearing surface may be of part-spherical form so as to allow the abutment member to swivel about axes transverse to the cable.

In one embodiment the bearing surface of the abutment engages an annular seating formed by a mouth in the anchor member through which the cable extends, the mouth widening in a direction towards said housing.

In a further embodiment, the bearing surface of the abutment engages a complementary concave seating formed by said anchor member, the cable passing through a mouth formed in said seating. In this case, the mouth is preferably formed as a slot which extends in the horizontal direction so as to assit the abutment member to pivot the concave seating as the door is opened.

Additionally, the cable preferably extends out of the housing through a mouth which widens in a direction outwardly of the housing, and in a preferred embodiment includes guide faces of smoothly curved form.

BRIEF DESCRIPTION OF THE DRAWINGS

These and other features of the invention will now be described by way of example with reference to the accompanying drawings in which:-

FIG. 1 shows a horizontal section through such a closer as installed in a door, with the door shown in an open position;

FIG. 2A shows a spanner for use with the door closer;

FIG. 2B shows a spacer member for use with the door closer;

DETAILED DESCRIPTION OF A PREFERRED EMBODIMENT

Figure 3:
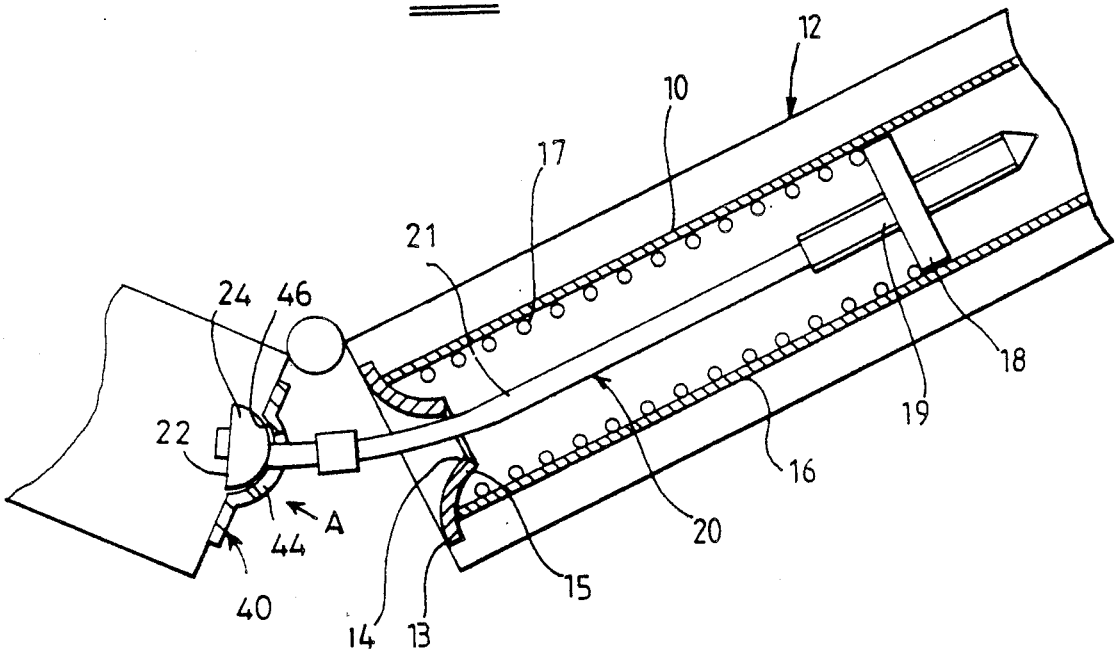
FIG. 3 shows a horizontal section through a second embodiment of a door closer.

In the accompanying illustration the invention is shown as applied to a simple door closer of the kind described in British patent specification No. 1044911. The closer consists of a housing 10 which is located within a bore formed within the door 12, and an anchor plate 30 or 40 which is mounted on the door frame 32.

The housing includes a mounting plate 13 having a mouth 14 bounded by an inwardly curving circular depression 15 pressed out from the mounting plate 13 to form a smooth convex guide surface and a tubular body 16 is assembled with said plate 13. Within the housing 10 a compression spring 17 acts between the mounting plate 13 and a disc-like member 18 which has an internally threaded bore by means of which it is adjustably mounted on a threaded rod-like member 19.

The anchor plate 30 of the first embodiment affords a mouth by inwardly circular curving depression 35 pressed out from the anchor plate to form a smooth convex guide surface.

The anchor plate is coupled to the rod-like member 18 by means of a tension member 20 which, in accordance with the invention, comprises a flexible cable 21 is fixedly secured to one end of the rod-like member 19. The cable 21 passes outwardly through the mouth 14 of the mounting plate 13 and through the mouth 34 of the anchor plate 30 and at its free end carries a fixed abutment 22 which is located within a recess formed for this purpose in the frame 30. The abutment 22 is of domed form so as to afford a radiused, and in the illustrated embodiment part-spherical, bearing surface 23 which engages an annular seating 36 afforded around the mouth 33 of the anchor plate 30.

It will be appreciated that the cable 21 can be cut to any required length according to the geometry of the particular hinge system with which the closer is to be used. However, instead of providing a fixed abutment member 22 at the end of the cable 21 secured for example by means of crimping, it would alternatively be possible to secure the abutment member by means of a grub screw so that the effective length of the cable can be adjusted at the point of installation.

In accordance with the invention a collar 25 is secured to the cable 21 at a position spaced from the abutment 22. It will be appreciated that the collar may be positioned on the cable prior to the attachment of the abutment 22, and preferably it is secured in position by a crimping operation which simultaneously deforms at least part of the outer surface of the collar which thereby acquires a non-round shape and is preferably of substantially hexagonal form. Alternatively the collar 25 may be secured by means of grub screw or by brazing or other similar methods.

The collar 25 then serves two purposes.

Firstly, it acts as an abutment for a spacer member 40 to be inserted between it and the mounting plate 13 so that the portion of the cable between the collar 25 and the abutment 22 is held clear of the housing 10.

The spacer member may comprise a thin metal plate 41 formed with a slot 42 of a width sufficient to receive the cable 21 so that the collar 25 engages the plate on opposite sides of the slot 42 and so prevented from entering the depression 15 in the mounting plate 13. This facilitates the installation of the anchor plate 30 on the door frame 32. After installation, it also enables the door to be held in an open position without imposing a strain on the anchor plate 30.

Secondly, due to its non-round form, the collar 25 can be engaged by a suitably shaped tool, for example in the form of a spanner 50, in such a manner as to enable the cable 21 to be rotated about its center line, thereby rotating the rod 19 to effect axial adjustment of the washer 18 relative to the rod, thereby adjusting the compression of the spring 17.

The smoothly domed form of the abutment 22 is also a significant feature of the invention in that it facilitates such rotation of the cable 21. Additionally, the domed form of the abutment 22 enables it to swivel about axes transverse to the length of the cable so that flexure of the cable as the door is opened and closed is reduced to a minimum.

Likewise, the smoothly radiused outwardly widening form of the depression 15 and 34 assists in minimising the curvature applied to the cable 21 as the door is opened, thus lengthening the working life of the cable, and also serves to guide the cable as it moves into and out of the housing, thereby reducing wear on the cable.

To prevent the collar 25 lodging inside the mouth 14 of the mounting plate 13 when the door is closed, the depression 15 may extend inwardly for a sufficient distance to ensure that the collar 25 does not pass into the interior of the housing 10 beyond the mouth 14 when the door is fully closed. Alternatively the edges of the mouth 14 may be radiused.

Whilst the non-round external shape of the collar 25 is particularly advantageous for the reasons mentioned above, nevertheless, the collar could be externally of cylindrical shape. This would be entirely satisfactory in a closer of a kind which does not require the tension member to be rotatable to adjust the spring force, but even where such rotation is required it could be obtained (albeit less conveniently than with the preferred non-round collar) by gripping the round collar by means of a suitable tool, such as a pair of pliers, and without thereby damaging the cable as would be the case should an attempt be made to grip the cable directly.

Moreover, whilst as illustrated the cable 21 effectively constitutes the entire length of the tension member 20, it will be appreciated that the rod-like member 19 could be of greater length than shown, or connected to an intermediate member to which a shorter cable is secured, only that part of the tension member 20 which may be drawn outwardly through the mouth 14 of the housing 10 being necessarily formed as a flexible cable in accordance with the invention.

Figure 4:
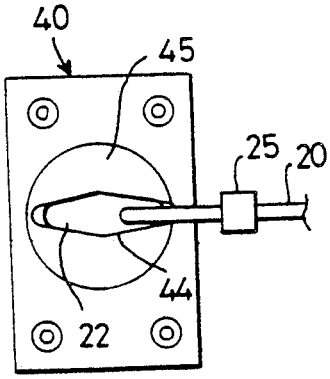
FIG. 4 shows a view in the direction of Arrow "A" in FIG. 3.

In the alternative embodiment illustrated in FIGS. 3 and 4, the housing 10 and other components which fit in the door are the same as shown in FIG. 1, but the way in which the cable 20 is assembled with the anchor plate 40 differs.

In this case, the abutment 22 carries by the cable is received within a concave seating 46 formed on the inside of a domed protruberance 25 formed outwardly in the plate 40. To enable the abutment to swivel about a vertical axis perpendicular to the axis of the door hinge, the mouth in the anchor plate through which the cable 20 extends is formed as a slot 44 as shown in FIG. 4. Thus, as the door 12 is opened, the abutment 22 is free to swivel to a greater extent than in the FIG. 1 embodiment, thus further reducing the curvature of the cable 20, particularly when the door is opened by 90° or more.

We claim:

1. A door closer, comprising:

a housing adapted for mounting within the thickness of a door and having a mouth at one end thereof;

an anchor plate adapted for mounting on a door frame at a position adjacent to said housing;

an elongate tension member comprising a flexible cable which terminates in an abutment member engaging behind said anchor member;

an externally threaded member secured to said cable at an end thereof within said housing;

an internally threaded member in threaded engagement with said externally threaded member and mounted within said housing such that rotation of said externally threaded member adjusts the axial position of said internally threaded member relative to said externally threaded member;

a spring member abutting said internally threaded member and operative to draw said anchor member and said housing towards one another, to thereby close the door relative to the frame; and a collar fixedly secured to said cable at a position spaced from said anchor member, said collar being so dimensioned as to be capable of entering said mouth of said housing.

2. A door closer according to claim 1, wherein said collar is of a non-round external shape so that by engagement of said collar with an appropriate tool the cable may be rotated about a center line of the cable to rotate said externally threaded member to adjust the compression of said spring member.

3. A door closer according to claim 2, wherein said collar is of hexagonal shape externally.

4. A door closer according to claim 1, wherein said mouth widens in a direction outwardly of the housing.

5. A door closer according to claim 4 wherein adjacent to said mouth the housing includes a depression affording a convex guide surface for said cable.

6. A door closer according to claim 1, wherein said abutment member is formed with a bearing surface which is symmetrical about the center line of the cable so as to facilitate rotation of the cable relative to the anchor member.

7. A door closer according to claim 6 wherein the bearing surface of the abutment member is of part-spherical form.

8. A door closer according to claim 7 wherein the anchor member is formed with a concave seating which is engaged by the bearing surface of said abutment member, and said concave seating affords a mouth through which said cable extends.

9. A door closer according to claim 8 wherein said mouth is formed as a slot which extends in a horizontal direction so as to assist the abutment member to pivot within the concave seating as the door is opened.

10. A door closer according to claim 1, wherein the anchor member includes a mouth through which said cable extends, the mouth widening in a direction towards said housing.

11. A door closer according to claim 10 wherein adjacent to said mouth of said anchor member, the anchor member is formed with a depression affording a convex guide surface for said cable.

12. A door closer according to claim 10 wherein the anchor member is formed with a concave seating which is engaged by the bearing surface of said abutment member, and said concave seating affords a mouth through which said cable extends.

* * * * *